United States Patent [19]

Cohen et al.

[11] 4,453,790

[45] Jun. 12, 1984

[54] CABINET DRAWER STOP ASSEMBLY

[75] Inventors: Joel B. Cohen, St. Davids; Matthew D. Marhefka, Southampton, both of Pa.

[73] Assignee: Shell Containers, Inc. (PA), Ambler, Pa.

[21] Appl. No.: 426,352

[22] Filed: Sep. 29, 1982

[51] Int. Cl.[3] ..... A47B 88/16

[52] U.S. Cl. ..... 312/348; 312/330 R

[58] Field of Search ..... 312/348, 330, 333

[56] References Cited

U.S. PATENT DOCUMENTS

| | | | |
|---|---|---|---|
| 2,123,803 | 7/1938 | Regenhardt | 312/348 |
| 2,522,361 | 9/1950 | Hill | 45/5 |
| 2,918,342 | 12/1959 | Tarte | 312/330 |
| 3,026,149 | 3/1962 | Ruhnke | 308/3.8 |
| 3,090,662 | 5/1963 | Dargene | 312/348 |
| 3,099,501 | 7/1963 | Hillson et al. | 312/348 |
| 3,733,113 | 5/1973 | Glassford et al. | 312/330 |
| 4,065,196 | 12/1977 | Stein | 312/348 |
| 4,190,306 | 2/1980 | Litchfield et al. | 312/330 |

*Primary Examiner*—William E. Lyddane
*Assistant Examiner*—Joseph Falk
*Attorney, Agent, or Firm*—Panitch, Schwarze, Jacobs & Nadel

[57] ABSTRACT

Cabinet drawers are supported by a pair of runners each received within side grooves on the drawer. A first limit stop on the runners cooperates with a mating limit stop adjacent the rear end of the drawer to prevent the drawer from inadvertently being pulled completely out. A third limit stop is provided on the runners for cooperating with the second limit stop when sufficient upward force is applied to the drawers to cause the first limit stop to fail to contact, or to skip past, the second limit stop.

6 Claims, 5 Drawing Figures

FIG. 1
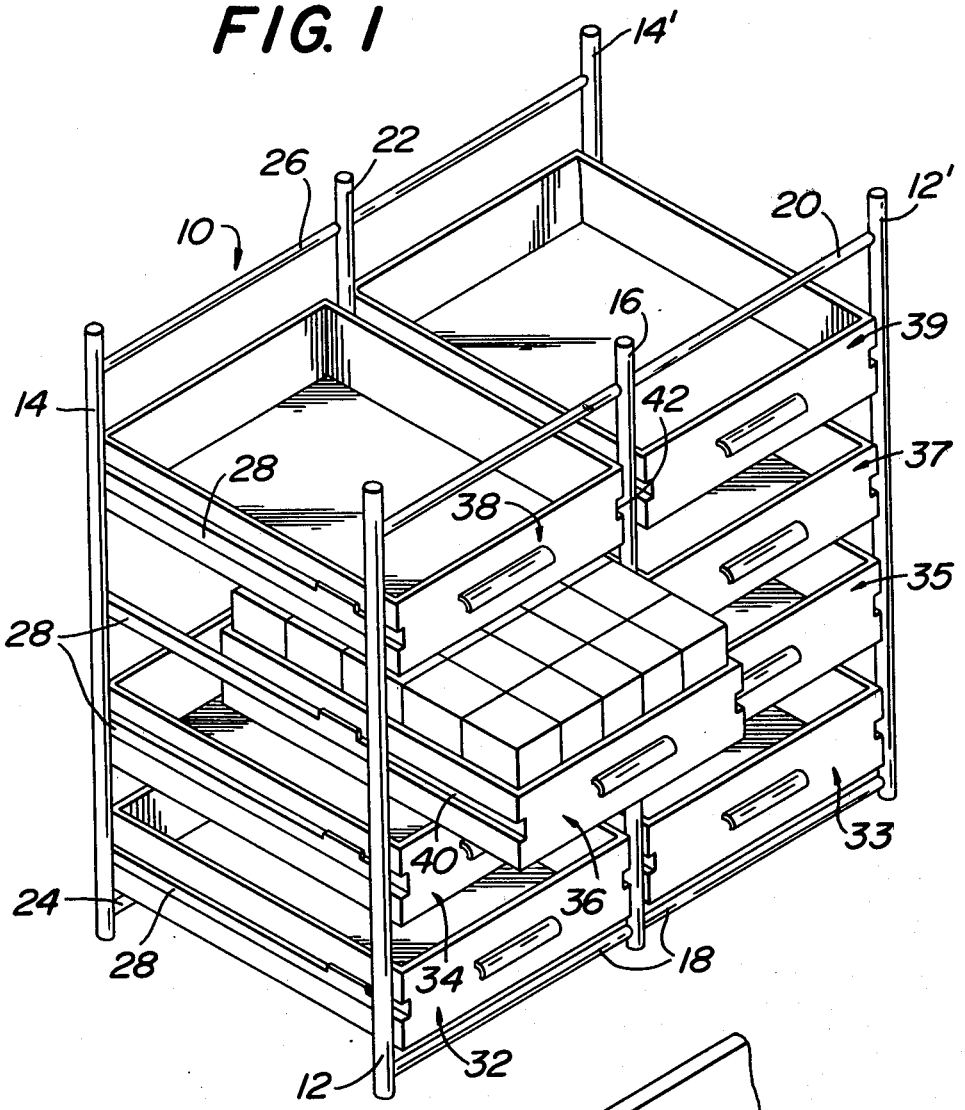
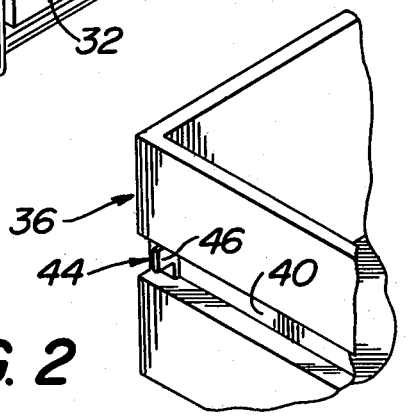
FIG. 2

FIG. 3
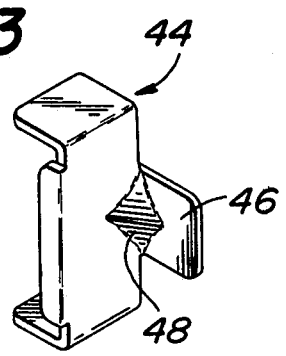
FIG. 4
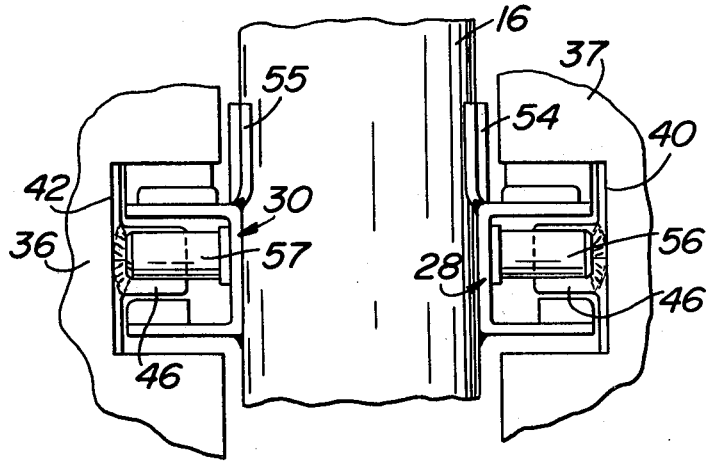
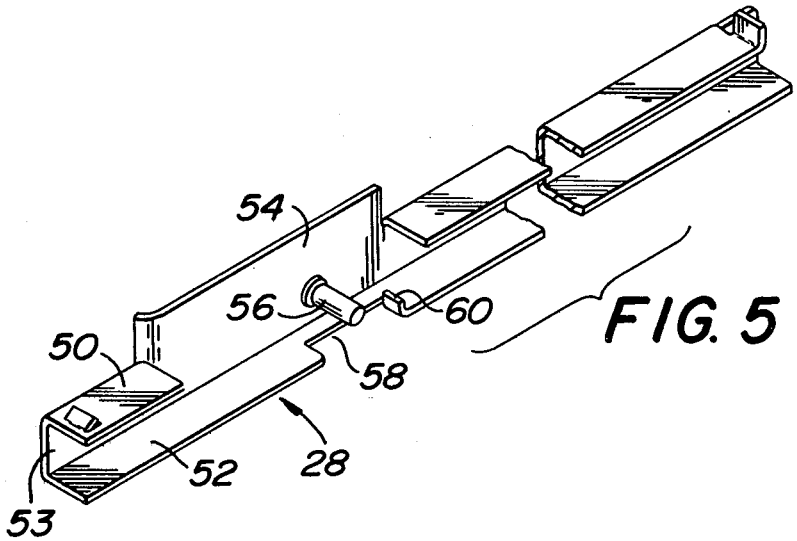
FIG. 5

CABINET DRAWER STOP ASSEMBLY

BACKGROUND OF THE INVENTION

Most drawer systems provide a stop which prevents the complete removal of a drawer in one continuous motion. Some drawer systems allow for complete removal of a drawer (after the stop has been engaged) by lifting the front of the drawer to disengage the stop, then pulling the drawer completely out of the system.

The danger in those types of systems is that when a drawer is being lifted and pulled out at the same time, the stopping and disengaging functions occur simultaneously, thus allowing the drawer to be inadvertently and completely removed from the system, in one continuous motion, without significant interruption. Even though the drawer stop engages the stop pin, the force of lifting and pulling at the same time causes the stop to hit and skip by the stop pin, without significant interruption. In some cases, if designed into the system, the stop could literally miss the stop pin.

Situations where drawers would be lifted while being pulled out and thereby inadvertently removed are:

1. Drawers located below waist level.
2. Drawers in systems without rollers —lifting would help minimize drag while pulling the drawer out.
3. Drawers in systems that incorporate an "in lock" detent where the front of the drawer must be lifted over a detent before pulling out.

The present invention is directed to a solution of that problem in a manner which is simple, inexpensive, and reliable without interfering with complete removal of the drawer when desired.

SUMMARY OF THE INVENTION

The present invention is directed to a cabinet having a frame and at least one moveable drawer. The drawer has a groove on the outer surface of opposite side walls. A pair of runners or tracks are supported by the cabinet frame. Each runner is received in one of the grooves on the drawer. A first limit stop on at least one of the runners is adapted to cooperate with a mating second limit stop on the drawer adjacent the rear end of the drawer for preventing the drawer from being inadvertently pulled completely out. An auxiliary or third limit stop is provided on said runner for cooperation with the second limit stop when sufficient upward force is applied to the drawer to cause the first limit stop to fail to contact, or to skip past, the second limit stop. The third limit stop is below the elevation of the first limit stop.

Various objects and advantages of the present invention are set forth hereinafter.

For the purpose of illustrating the invention, there is shown in the drawings a form which is presently preferred; it being understood, however, that this invention is not limited to the precise arrangements and instrumentalities shown.

FIG. 1 is a perspective view of one form of cabinet incorporating the present invention.

FIG. 2 is a partial perspective view of the rear end of a drawer at a corner thereof.

FIG. 3 is a perspective view of a limit stop attached to the rear end of the drawer.

FIG. 4 is a front elevation view showing a portion of an intermediate vertical member of the cabinet frame and portions of adjacent drawers.

FIG. 5 is a perspective view of a runner or track.

DETAILED DESCRIPTION

Referring to the drawing in detail, wherein like numerals indicate like elements, there is shown in FIG. 1 a form of a cabinet designated generally as 10. The cabinet may assume other forms such as a desk having a plurality of vertically disposed drawers.

The cabinet 10 includes a frame. As illustrated, the cabinet frame includes front vertically disposed corner members 12 and 12' with an intermediate member 16 therebetween. The frame also includes rear vertical corner members 14, 14' with a rear intermediate member 22 disposed therebetween. The members 12, 12' and 16 are horizontally coupled together in a rigid manner such as by way of a bottom brace 18 and a top brace 20. The braces 18 and 20 extend through member 16 and are fixedly secured to the members 12 and 12' in any convenient manner such as by welding.

The rear members 14, 14' and 22 are rigidly coupled together by way of a bottom brace 24 and a top brace 26 as described above. Members 12 and 14 are rigidly interconnected together by a plurality of runners 28. Members 16 and 22 are rigidly coupled together by a plurality of runners 28 and 30 as shown more clearly in FIG. 4. Members 12' and 14' are rigidly coupled together by a plurality of runners 30. The runners 28 and 30 are identical except that runners 28 are of the left hand while runners 30 are of the right hand. The runners act as a track for drawers.

The cabinet 10 as illustrated includes a plurality of drawers designated 32–39. The drawers in the manner in which they cooperate with their associated runners or tracks are identical. Hence, only drawer 36 will be described in detail.

Drawer 36 has a longitudinally extending groove 40 on one side wall and a similar groove 42 on the opposite side wall. Each runner 28 is received in a groove 40 and each runner 30 is received in a groove 42.

At the rear end of the grooves 40, 42 adjacent the corners of the drawer 36, there is provided a limit stop 44 having a projection 46. See FIGS. 2 and 3. The height of projection 46 is substantially less than the height of the grooves 40, 42 so that the drawer 36 may be completely removed from the cabinet 10 when desired.

In FIG. 5, there is illustrated a runner or track 28. The runner 28 is generally C-shaped in section with a top wall 50 connected to a bottom wall 52 by a vertically disposed bight 53. The bight 53 is welded or otherwise fixedly secured to the members 12 and 14. The top wall 50 is cut at two locations with the portion 54 between the cuts being bent so as to extend upwardly as a continuation of the bight 53. Portion 54 contacts the outer surface of the side wall of the drawer 36. A similar portion 55 on runner 30 cooperates with portion 54 to guide the drawer 36. Portions 54, 55 are spaced from one another by a distance slightly greater than the width of the drawer 36. Except for portions 54, 55, the runners 28 and 30 extend into their associated grooves 40, 42 respectively.

A limit stop 56 in the form of a pin extends inwardly from the bight 53. Limit stop 56 is adapted to cooperate with the projection 46 on limit stop 44 in groove 40. Runner 30 is provided with a similar limit stop 57. A notch 58 is provided on the bottom wall 52 at the edge thereof remote from the bight 53. A portion of the metal cut from notch 58 is bent upwardly to form a third limit stop 60. Limit stop 60 is below the elevation of limit stop 56 and is longitudinally spaced from limit stop 56 on the runner 28. See FIG. 5.

Portions 54, 55 are preferably permitted to remain as part of the runners for strength and to keep the drawer 36 from being grossly misaligned in that portion of the runners. The cut out area formerly occupied by portions 54, 55 allows the rear of the drawers 36, when adjacent thereto to drop when the front is lifted. The notch 58 allows limit stop 46 pass beneath limit stop 56 when the front of the drawer is lifted, and an outward pulling force is applied.

When drawer 36 is pulled horizontally outwardly, it will be prevented from being completely withdrawn by contact between limit stops 56 and 46. If it is desired to completely remove drawer 36 so that it may be moved to another location for loading or unloading, drawer 36 is pulled out until limit stop 56 contacts limit stop 46. Then an upward force is applied to the front of the drawer 36 so as to slightly pivot the drawer and cause the limit stop 46 to pass beneath the limit stop 56. Thereafter, the drawer 36 is easily removed.

If an upward force is applied to the front of the drawer 36 while pulling the drawer 36 outwardly, the drawer 36 will be prevented from inadvertently being pulled completely out by contact between limit stops 60 and 46. Under normal operating conditions, without any upward force being applied to the drawer, limit stop 46 will pass over limit stop 60 until it contacts limit stop 56. Thus, it will be seen that the present invention provides a third or auxiliary limit stop to prohibit inadvertent complete removal of the drawer 36 from its runners 28, 30. The third limit stop does not require the use of any moveable parts or any additional parts since it is formed out of existing structure. That is a distinct advantage since it minimizes cost and contributes to the simplicity of the cabinet.

The present invention may be embodied in other specific forms without departing from the spirit or essential attributes thereof and, accordingly, reference should be made to the appended claims, rather than to the foregoing specification, as indicating the scope of the invention.

We claim:

1. A cabinet having at least one moveable drawer comprising a cabinet frame supporting a pair of substantially horizontal runners, a drawer having a groove on the outer surface of opposite side walls, each runner being received in one of said grooves, a first limit stop on at least one of the runners and adapted to cooperate with a mating second limit stop on the drawer adjacent the rear end of the groove associated with said one runner for preventing the drawer from being inadvertently completely pulled out, a third limit stop comprising an upwardly extending projection on the bottom of said one runner for cooperation with the second limit stop when sufficient upward force is applied to the drawer to cause the first limit stop to fail to contact or to skip past, the second limit stop, said third limit stop being below the elevation of said first limit stop and longitudinally spaced therefrom.

2. A cabinet in accordance with claim 1 wherein said one runner is provided with a horizontally disposed top wall connected to a horizontally disposed bottom wall by a vertically disposed bight, said first limit stop projecting horizontally from said bight.

3. A cabinet in accordance with claim 2 including a notch along a free edge of said runner bottom wall, at least a portion of the material from said notch being bent upwardly to form said third limit stop.

4. A cabinet in accordance with claim 1 wherein said frame includes front corner members vertically disposed, an intermediate member connected to said front corner members by horizontally disposed braces, rear vertically disposed corner members with an intermediate member coupled thereto by horizontally disposed rear braces, said front members being connected to an associated rear member by said runners.

5. A cabinet in accordance with claim 2 including a notch in the runner bottom wall below said first limit stop so that the second limit stop may enter the notch and permit the intentional withdrawal of the drawer from the cabinet.

6. A cabinet in accordance with claim 2 wherein a portion of the runner top wall is bent upwardly and forms a continuation of the bight.

* * * * *